United States Patent [19]

Matsuda

[11] Patent Number: 4,806,020

[45] Date of Patent: Feb. 21, 1989

[54] MAGNETIC ROTATOR

[75] Inventor: Kazue Matsuda, Miyagi, Japan

[73] Assignee: Sendai Mechanic Kogyo Kabushiki Kaisha, Miyagi, Japan

[21] Appl. No.: 98,342

[22] Filed: Sep. 18, 1987

[51] Int. Cl.[4] ..... B01F 13/08

[52] U.S. Cl. ..... 366/273; 384/907.1; 417/420

[58] Field of Search ..... 366/279, 273, 274, 348, 366/349; 417/420; 384/907.1, 571

[56] References Cited

U.S. PATENT DOCUMENTS 3,022,685 2/1962 Armacost ..... 384/907.1

4,184,090 1/1980 Taiani ..... 417/420

4,209,259 6/1980 Rains ..... 366/273

FOREIGN PATENT DOCUMENTS 1023637 3/1966 United Kingdom ..... 384/517

*Primary Examiner*—Robert W. Jenkins

*Attorney, Agent, or Firm*—Wegner & Bretschneider

[57] ABSTRACT

A magnetic rotator designed to extend through a hole formed in a nonmagnetic container includes magnets of opposite polarities attached to the ends of rotating shafts received in two cylinders mounted face-to-face through a flange. Interposed between the rotating shafts and the cylinders are conical roll bearings of ceramics.

3 Claims, 2 Drawing Sheets

MAGNETIC ROTATOR

BACKGROUND OF THE INVENTION

1. Field of the Invention

The present invention relates to a magnetic rotator designed for use with a stirrer or agitator for externally rotating the member to be rotated which is placed in a container, while the container is sealed.

2. Statement of the Prior Art

In general, a device for rotating the member to be rotated in a container has its rotating shaft passed through, for instance, the bottom face of the container and rotated from the outside of the container by means of a driving unit such as a motor. To keep airtightness between the container and the rotating shaft, some means such as packing and liquid sealing have been used (Japanese Utility Model Laid-Open No. 56-63161).

Such a conventional rotator has had difficulty in keeping a high degree of airtightness because of its rotating shaft passing through a wall face of a container and, moreover, has offered a problem that, when it rotates at a high speed, the degree of vacuum in the container drops due to the heat of friction generated on its sealed portion.

SUMMARY OF THE INVENTION

The present invention has been accomplished so as to solve such problems, and has for its object to provide a rotator enabling high-speed rotation, while keeping airtightness in a container.

According to the present invention, this object is achieved by the provision of a magnetic rotator designed to extend through a hole formed in a nonmagnetic container, said rotator being characterized in that magnets of opposite polarities are attached to the ends of rotating shafts received in two cylinders mounted face-to-face through a flange.

BRIEF DESCRIPTION OF THE DRAWINGS

One preferred embodiment of the present invention will now be explained in detail with reference to the accompanying drawings which are given for the purpose of illustration alone, and in which.

PREFERRED EMBODIMENT OF THE INVENTION

Figure 1:
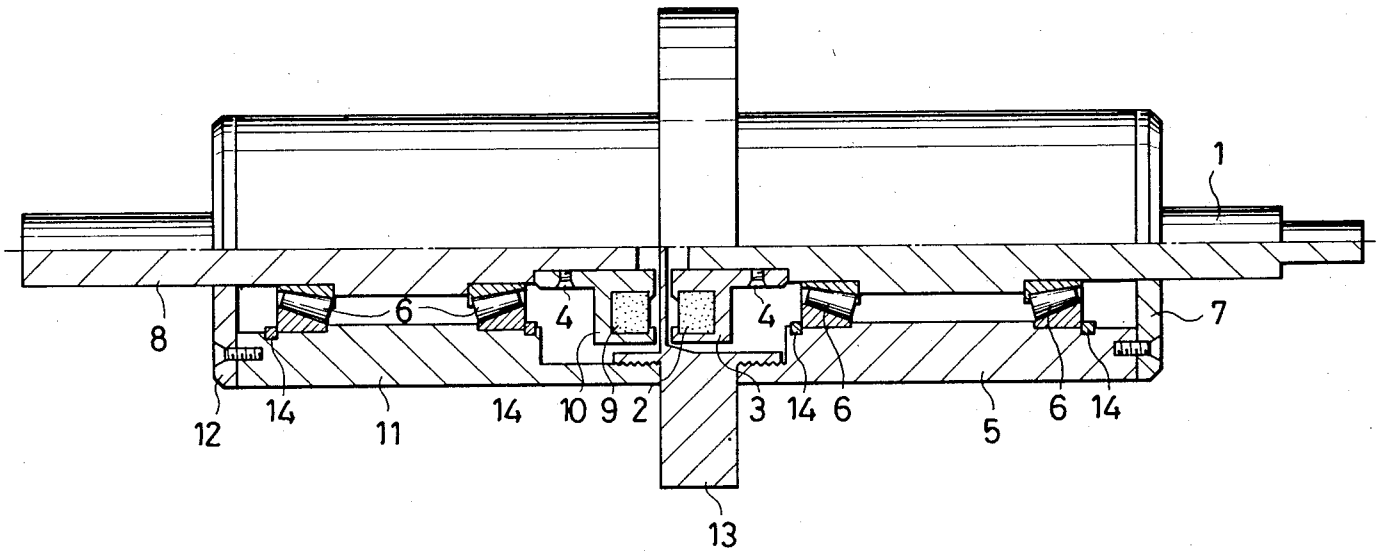
FIG. 1 is a view, centrally cross-sectioned, of one embodiment of the rotator according to the present invention.

An outer rotating shaft 1 is provided at its end with a holder 3 by means of racing-preventing screws 4, said holder surrounding said end of the shaft 1 and receiving four solid permanent magnets 2, and is rotatably mounted in a cylinder 5 through conical roller bearings 6 . . . . A lid 7 is screwed onto the back side of the shaft 1.

An inner rotating shaft 8 is provided at its end with a holder 10 by means of racing-preventing screws 4, said holder surrounding said end of the shaft 8 and receiving four solid permanent magnets 9 of polarity opposite to that of the aforesaid magnets 2, and is rotatably mounted in a cylnder 11 through conical roller bearings 6 . . . . A lid 12 is screwed into the back side of the shaft 8.

The respective rear ends of the inner and outer shafts 1 and 8 are extended from the lids 7 and 12 to provide portions to which are attached a driving motor and a rotating roll, respectively, as will be described later.

Interposed between both cylinders 5 and 11 is a flange 13 which is integrally provided on one side with a recess for receiving the holder 3 of the outer rotating shaft 1 and a threaded peripheral edge onto which is screwed an inner threaded portion of the end of the cylinder 5 and on the opposite side with a threaded peripheral edge onto which is screwed an inner threaded portion of the cylinder 11 for the inner rotating shaft 8.

Reference numeral 14 ... stands for ring stoppers for preventing leaping-out of the conical roller bearings.

Figure 2:
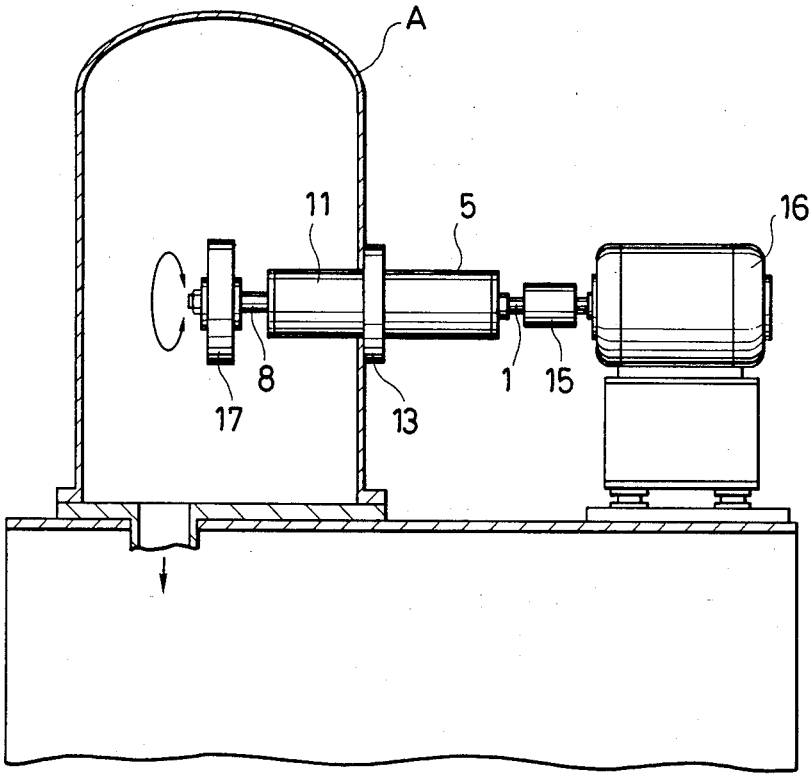
FIG. 2 is a view, partly sectioned, of that embodiment which is attached to a container.

Referring to how to use the magnetic rotator of the aforesaid structure according to the present invention, the flange 13 is completely fitted to a wall face of a container A having a hole through which the inner cylinder 11 is to be passed, as illustrated in FIG. 2. More specifically, the flange 13 may be fitted to the wall face of the container A by welding, or may completely be sealed to the wall face of the container A with known rubber packings, caulks or the like being put therebetween.

The outer rotating shaft 1 is connected to a driving shaft of a motor 15 by way of a coupling 15, and the inner rotating shaft 8 is provided with a rotating roll 17.

Then, the container A is evacuated by means of a vacuum pump (not shown), and the motor 16 is energized to rotate the outer rotating shaft 1, the rotation of which is in turn transmitted to the inner rotating shaft 8 via the permanent magnets 2 and 9 to rotate the rotating roll 17 and, hence, the member to be rotated in the container A.

It is to be understood that while the foregoing embodiment has been described as using four solid magnets as the magnets, no limitation is imposed upon the number and shape of magnets, if they can transmit the rotation of the outer rotating shaft to the inner rotating shaft.

According to the present invention, the rotating portions are not passed through the container. Thus, no matter how fast the rotator works, it is unlikely that any heat of friction may be generated between the wall face and the rotating shaft passing therethrough, as encountered in the prior art. Nor is the airtightness in the container impaired. The magnetic rotator of the present invention is thus suitable for the study and production of amorphous materials, etc., needing a particularly high degree of vacuum.

Further, since the conical roller bearings of ceramics are provided between the rotating shafts and the cylinders, any lubrication is not required, unlike the conventional ball bearings. In particular, since the cylinders exposed in the container are unlikely to be contaimnated, it is always possible to keep clean the interior of the container. Thus, the magnetic rotator of the present invention can be used even in a liquid, and offers many other advantags over the prior art.

What is claimed is:

1. A magnetic rotator designed to extend through a hole formed in a nonmagnetic container, in which magnets of opposite polarities are attached to the adjacent ends of rotating shafts received in two cylinders mounted face-to-face through a flange.

2. A magnetic rotator as defined in claim 1, wherein said flange between said two cylinders is airtightly fixed in a hole formed in said nonmagnetic container, thereby mounting said flange on said container.

3. A magnetic rotator designed to extend through a hole formed in a non-magnetic container, in which magnets of opposite polarities are attached to the adjacent ends of rotating shafts received in two cylinders mounted face-to-face through a flange wherein conical roller bearings of ceramics are interposed between said rotating shafts and said cylinders.

* * * * *